US006580664B2

(12) United States Patent
Magnusson

(10) Patent No.: US 6,580,664 B2
(45) Date of Patent: Jun. 17, 2003

(54) TIMEPIECE WITH PAGER AND GLOBAL POSITIONING SYSTEM

(76) Inventor: Derek A. Magnusson, 101 Park Pl., Midwest City, OK (US) 73110

( * ) Notice: Subject to any disclaimer, the term of this patent is extended or adjusted under 35 U.S.C. 154(b) by 0 days.

(21) Appl. No.: 09/933,613

(22) Filed: Aug. 21, 2001

(65) Prior Publication Data

US 2003/0039174 A1 Feb. 27, 2003

(51) Int. Cl.[7] ..... G04C 11/02; G04C 19/00
(52) U.S. Cl. ..... 368/47; 368/82; 368/223
(58) Field of Search ..... 368/47, 82–84, 368/223, 242

(56) References Cited

U.S. PATENT DOCUMENTS

| | | | | | |
|---|---|---|---|---|---|
| 4,077,032 | A | | 2/1978 | Volkman | |
| 4,470,708 | A | * | 9/1984 | Nee | 368/223 |
| 4,903,250 | A | | 2/1990 | Cho | |
| 5,262,763 | A | * | 11/1993 | Okuyama et al. | 345/169 |
| 5,297,118 | A | | 3/1994 | Sakumoto | |
| 5,329,501 | A | | 7/1994 | Meister et al. | |
| 5,471,438 | A | | 11/1995 | Kobayashi et al. | |
| 5,475,653 | A | | 12/1995 | Yamada et al. | |
| 5,485,163 | A | | 1/1996 | Singer et al. | |
| 5,497,149 | A | | 3/1996 | Fast | |
| 5,528,559 | A | | 6/1996 | Lucas | |
| 5,572,196 | A | | 11/1996 | Sakumoto et al. | |
| 5,572,488 | A | | 11/1996 | Yamada et al. | |
| 5,742,233 | A | | 4/1998 | Hoffman et al. | |
| 5,771,001 | A | | 6/1998 | Cobb | |
| 5,790,477 | A | * | 8/1998 | Hauke | 368/10 |
| 5,982,710 | A | * | 11/1999 | Rawat et al. | 368/21 |
| 6,158,884 | A | * | 12/2000 | Lebby et al. | 221/165 |
| 6,212,133 | B1 | * | 4/2001 | McCoy et al. | 342/357.12 |

* cited by examiner

*Primary Examiner*—David Martin
*Assistant Examiner*—Michael L. Lindinger
(74) *Attorney, Agent, or Firm*—Dale J. Ream

(57) ABSTRACT

A timepiece with a pager includes a watch housing having an upper portion hingedly coupled to a lower portion. A timekeeping assembly and pager with a corresponding display are housed within the upper portion. A digital display is positioned on the lower face of the upper portion for displaying information relative to a pager message. The pager and timekeeping displays may be viewed without obstruction when the upper portion is in an open position. A global positioning system is housed within the lower portion with data generated thereby being displayed on a digital display positioned therein. The global positioning system is powered upon an opening of the upper portion and deactivated upon a closing thereof. The global positioning display may be viewed without obstruction by the timekeeping or pager displays.

4 Claims, 7 Drawing Sheets

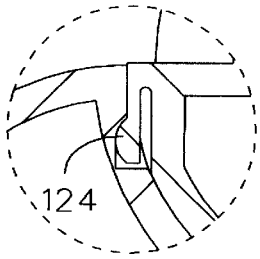
FIG. 5b
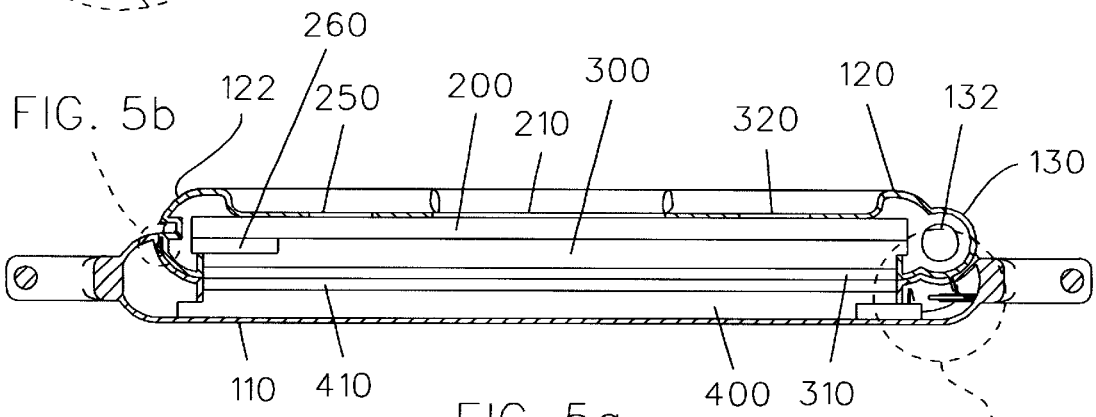
FIG. 5b
FIG. 5a
FIG. 5c
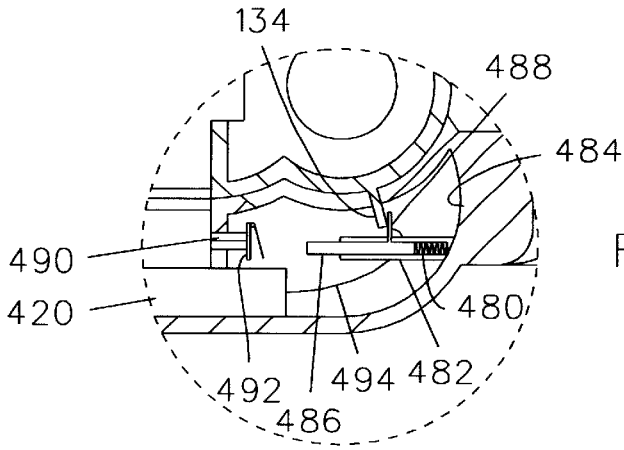
FIG. 5c

112

122
124
260
310
300
250
200
210
320

110
410
400

132
134
130
486
484
490
482
420
480
492
494

TIMEPIECE WITH PAGER AND GLOBAL POSITIONING SYSTEM

BACKGROUND OF THE INVENTION

This invention relates generally to a combination timepiece with a pager and global positioning system and, more particularly, to a timepiece having separate and distinct displays for displaying data relative to a timepiece, pager, and global positioning system.

Persons who frequently travel away from their homes or offices often rely on several different devices to communicate with family members and employers or to verify their geographic position. Such communication and navigation devices include cellular telephones, pagers, global positioning systems, radios, etc. It may quickly become cumbersome to carry or store such devices if two or more of such devices are needed. While the inconvenience of carrying multiple communication and navigation devices is experienced even relative to vehicle travel, the problem of maintaining possession of such devices is even more difficult for individuals who need to venture away from a vehicle or place of business for a period of time.

Devices that combine a timepiece with a pager are known in the art. Although several display mechanisms are disclosed, extensive amounts of pager data cannot be displayed by existing devices without some obstruction of view by hands of the timepiece or without temporarily suspending the timekeeping function. Additionally, known pager displays cannot be completely hidden from view when not in use.

Global positioning systems (GPS) for personal navigation are also known in the art. Such devices, however, must be carried or stored in addition to other communication devices in a vehicle or on a person's body.

Therefore, it is desirable to have a timepiece with a pager and global positioning system. It is further desirable to have a timepiece with separate and distinct displays for each additional functional device. It is also desirable that the GPS device is actuated only upon a user opening a hinged watch cover.

SUMMARY OF THE INVENTION

A timepiece constructed in accordance with the present invention utilizes a watch housing having a lower portion and an upper portion. The upper portion is hingedly coupled to the lower portion such that the upper portion can be selectively pivoted between an open and closed configuration. A conventional timekeeping assembly and pager are mounted within the upper portion of the watch housing and are continuously powered by a battery. The upper face of the upper portion includes an analog display having watch hands for indicating the relative time of day. A digital display is positioned on the lower face of the upper portion for displaying information relative to messages received by the pager. The pager display may be viewed by pivoting the upper portion to an open configuration.

A global positioning system (GPS) is mounted within the lower portion of the watch housing and provides standard GPS data to a digital display positioned on the upper face of the lower portion. The GPS is selectively powered by a battery upon the upper portion being placed in an open configuration. Thus, as the watch housing is opened, power is delivered to the GPS. Each display utilized by the present invention is separate and distinct from the other displays such that each one may be viewed without obstruction or interference.

Therefore, a general object of this invention is to provide a timepiece having a pager and a global positioning system within a watch housing.

Another object of this invention is to provide a timepiece, as aforesaid, which can display time, pager, and global positioning data on separate and distinct displays.

Still another object of this invention is to provide a timepiece, as aforesaid, wherein the pager and global position display mechanisms are hidden from view until a hingeable cover is raised.

Yet another object of this invention is to provide a timepiece, as aforesaid, which indicates when a message has been received by the pager.

A further object of this invention is to provide a timepiece, as aforesaid, in which power is delivered to the global position device upon raising the cover.

Yet another object of this invention is to provide a timepiece, as aforesaid, having buttons for manipulating time, pager, and global positioning functions.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 5A is a sectional view of the timepiece taken along line 5—5 of FIG. 2A;

FIG. 5B is an enlarged isolated view of the watch housing closure assembly as in FIG. 5A in a closed configuration;

FIG. 5C is an enlarged isolated view of the global positioning system as in FIG. 5A with the activation switch in an open configuration;

FIG. 6 is a sectional view of the timepiece taken along line 6—6 of FIG. 7B;

DESCRIPTION OF THE PREFERRED EMBODIMENT

Figure 1:
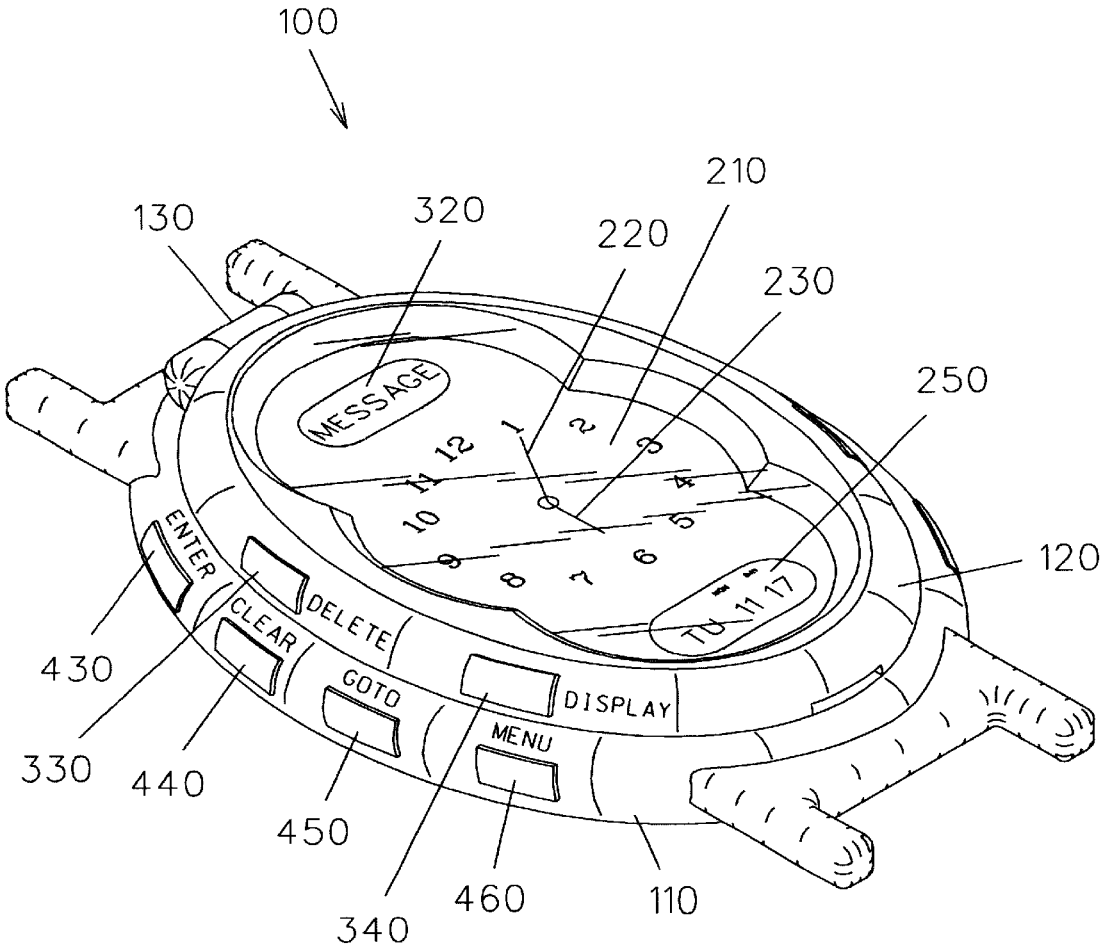
FIG. 1 is a perspective view of the timepiece according to the preferred embodiment of the present invention.
Figures 6A, 6B, 6C:
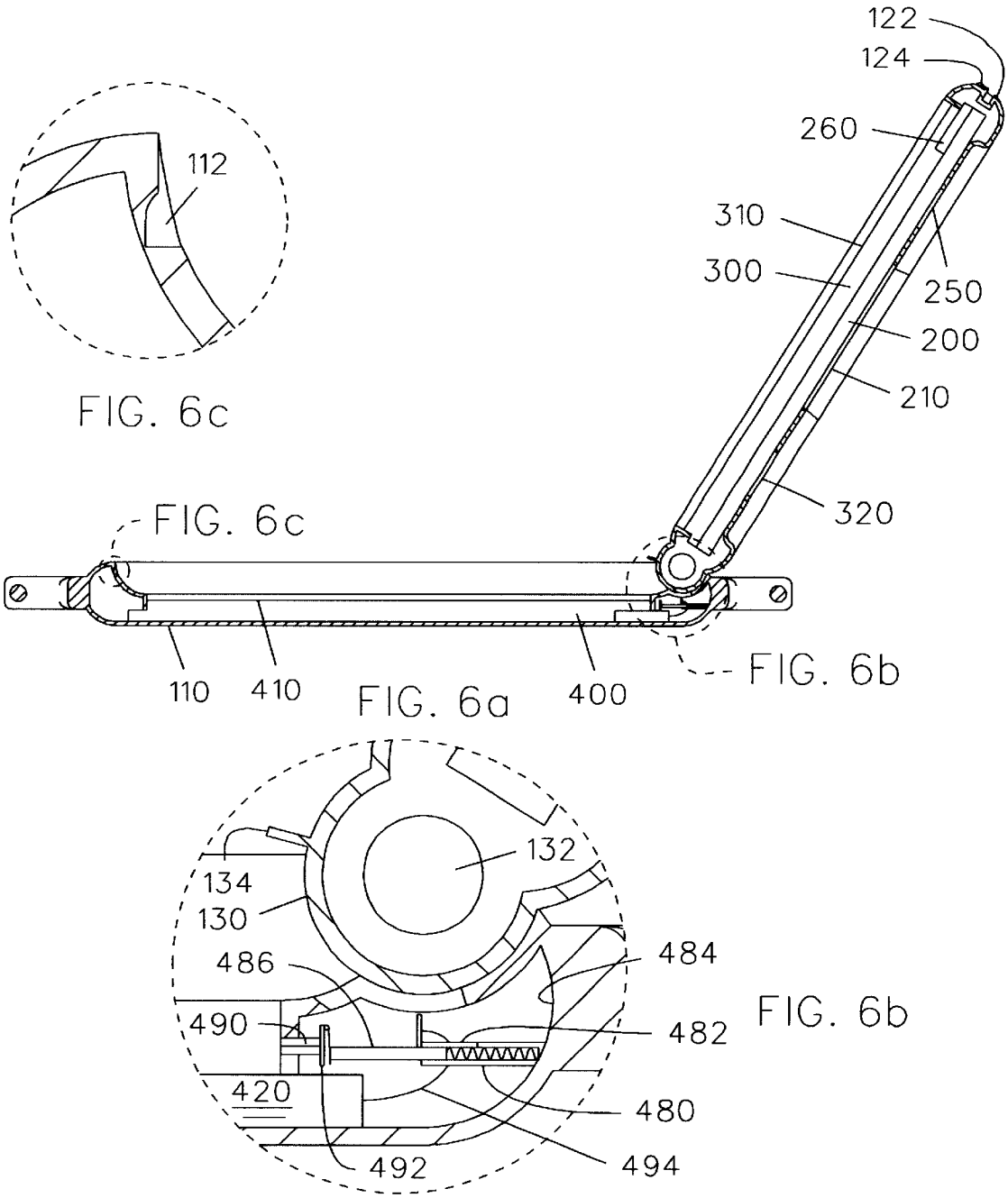
FIG. 6B is an enlarged isolated view of the global positioning system activation switch as in FIG. 6A in a closed or activated configuration.
FIG. 6C is an enlarged isolated view of the watch housing closure assembly as in FIG. 6A in an open configuration.
Figures 7A, 7B, 7C, 7D:
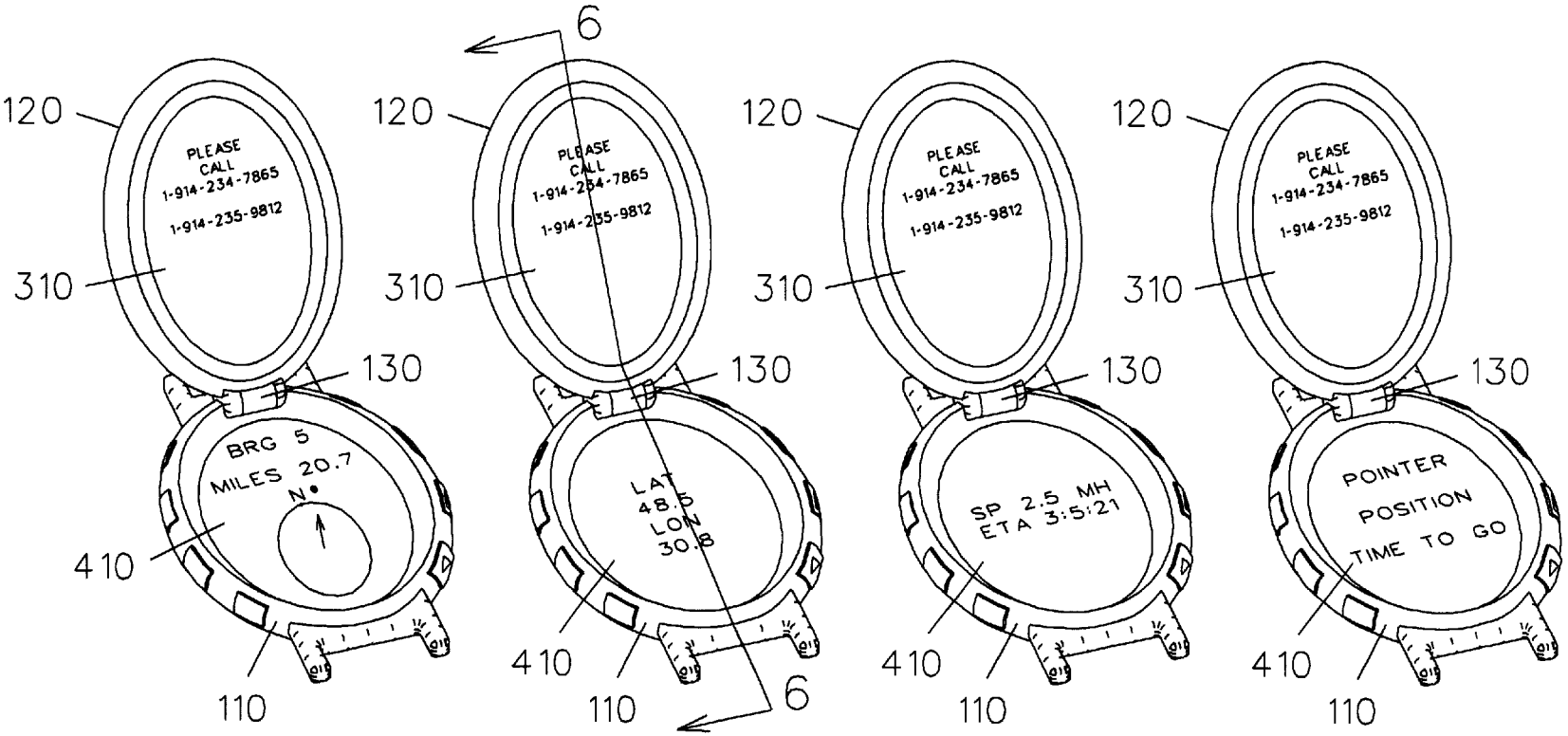
FIGS. 7A–7D are perspective views of the timepiece of FIG. 1 in an open configuration showing the global positioning device display in various modes.

A timepiece constructed in accordance with a preferred embodiment of the present invention is shown in FIG. 1. The timepiece includes a watch housing 100 having a lower portion 110 and an upper portion 120. The upper portion 120 is coupled to the lower portion 110 by a hinge 130 including a pin 132 (FIG. 5A) so that the upper portion 120 is selectively pivotable between open and closed configurations. As shown in FIGS. 5B and 6C, a free end 122 of the upper portion 120 defines a recess 112 therein. The free end 122 also presents a downwardly extending bulbous flange 124 configured for frictional engagement with a complementary recess 112 defined by the lower portion 110. Accordingly, the upper portion 120 may be releasably coupled to the lower portion 110 by pressing the flange 124 into engagement with the lower portion recess 112 (FIG. 5B). Conversely, the upper portion 120 may be opened by a user inserting a finger into the upper portion recess 112 and pulling upward to release the frictional engagement of the flange 124 and recess 112. The watch housing is constructed of a durable material that is generally waterproof and shock resistant.

A timekeeping assembly 200 and pager 300 are mounted within the upper portion 120 of the watch housing 100. These devices are known in the art and are thus designated generally in the drawings by reference numbers 200 and 300 (FIGS. 5A and 6A). A global positioning system (GPS) 400, also known in the art, is mounted within the lower portion 110 (FIGS. 5A and 6A).

Figure 2A:
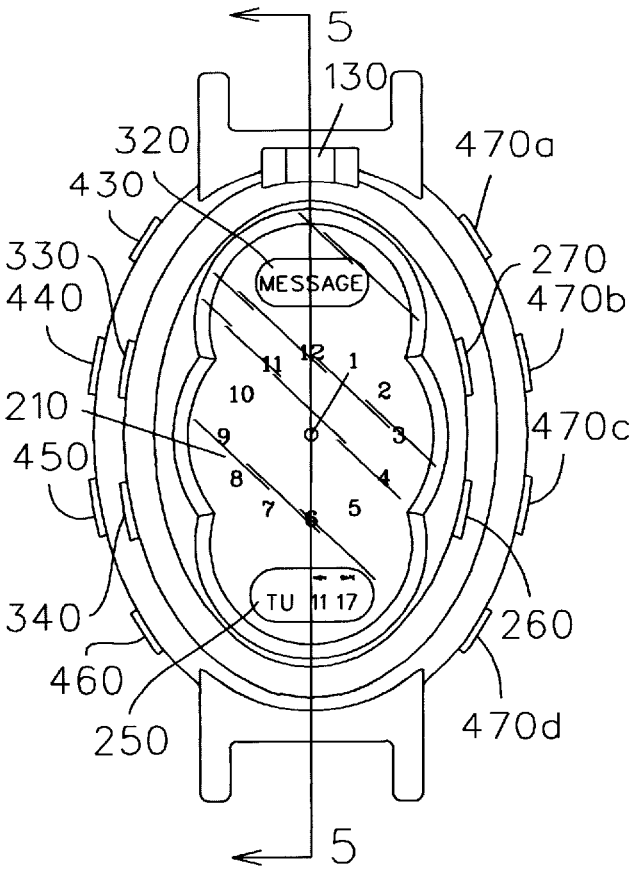
FIG. 2A is a front view of the clock mechanism of the timepiece of FIG. 1.
Figure 2B:
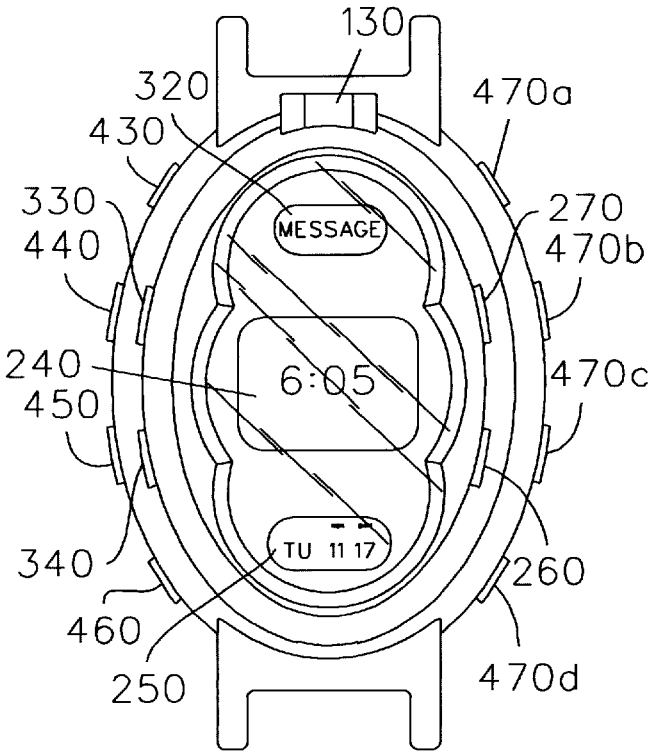
FIG. 2B is a front view of the clock mechanism according to a second embodiment of the timepiece.
Figure 3:
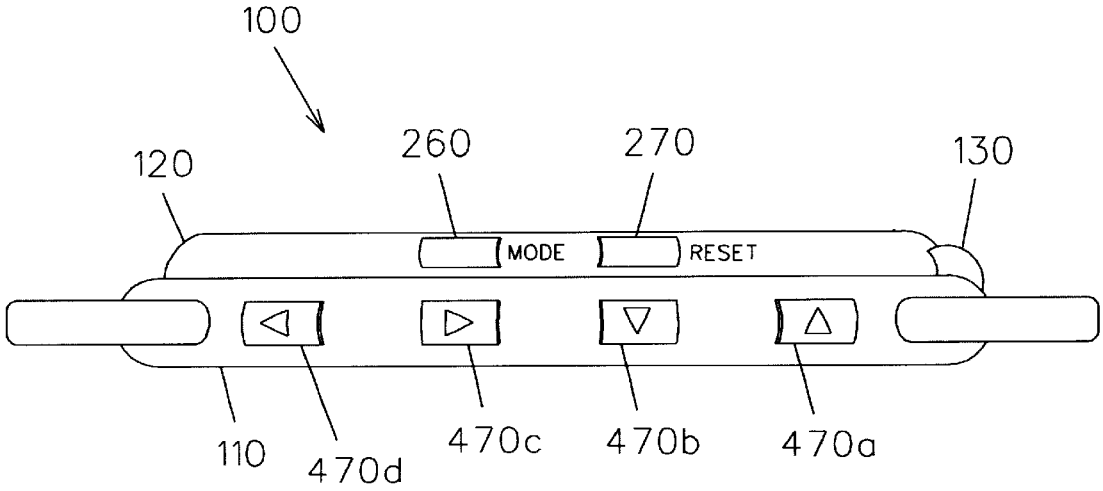
FIG. 3 is a right side view of the timepiece of FIG. 1 showing buttons for controlling the pager and global positioning system.
Figure 4:
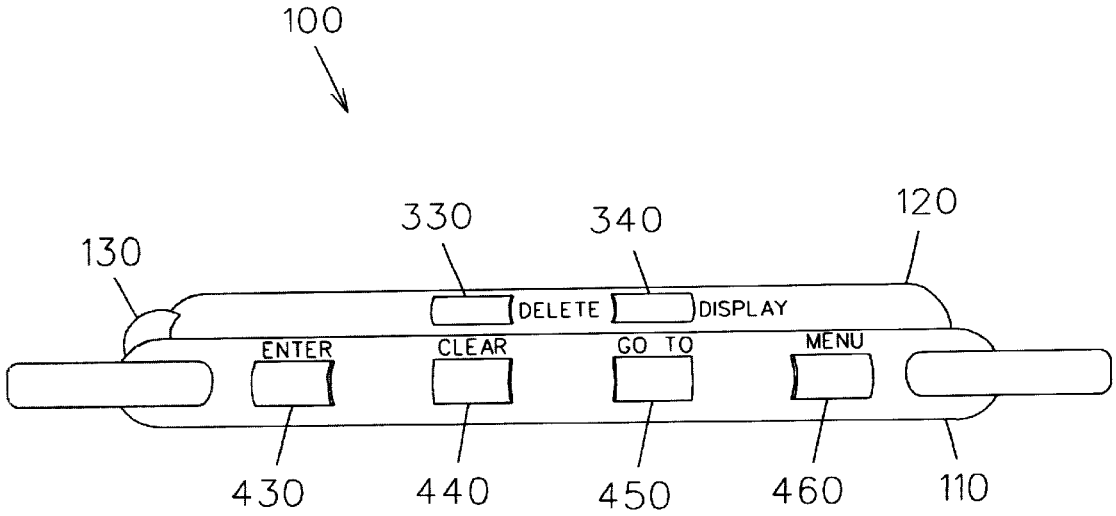
FIG. 4 is a left side view of the timepiece of FIG. 1 showing buttons for controlling the timepiece and global positioning system.

The upper face of the upper portion 120 of the watch housing 100 includes an analog display 210 having an hour hand 220 and a minute hand 230 for visually indicating the relative time of day (FIG. 1). Another hand for indicating the seconds of a minute may also be provided (not shown). The hands are controlled by the timekeeping assembly 200 in the traditional manner. A digital date display 250 is also included on the upper face of the upper portion 120. The upper face of the upper portion 120 also includes a message indicator display 320 which visually indicates to the user that a message has been received by the pager 300. The message indicator display 320 preferably includes indicia, such as "MESSAGE", which is illuminated by a light emitting diode upon receipt of a message by the pager 300. Alternatively, an audible indicator may be provided to alert a user that a message has been received. Further, the upper face of the upper portion 120 may alternatively include a digital display 240, such as a liquid crystal display, for indicating the relative time as shown in FIG. 2B. Mode button 260 and reset button 270 extend from a side of the upper portion 120 for selecting typical watch functions (FIG. 3).

The lower face of the upper portion 120 of the watch housing 100 includes a digital display 310 that generally covers the entire lower face for displaying pager message data in the manner known in the art. The digital pager display 310 is preferably a liquid crystal display. The pager display 310 is viewable by a user upon rotating the upper portion 120 to an open configuration as shown in FIGS. 7A through 7D. Messages received by the pager 300 are manipulated in the conventional manner by pressing the delete 330 and display 340 buttons that extend from a side of the upper portion 120 (FIG. 1). It should be appreciated that the entire pager display 310 may be viewed without obstruction by the hands of the timekeeping display 210. When all messages have been viewed or deleted, the upper portion 120 may be rotated to a closed configuration for viewing the timekeeping display 210 and for concealing or protecting the pager display 310. The timekeeping assembly 200 and pager 300 are continuously powered by a conventional battery 260.

The lower portion 110 of the watch housing 100 includes a digital display 410 which substantially covers the entire upper face thereof. The display 410 is sufficiently large so as to completely display various types of data generated by the global position system; namely, directional data, position coordinates such as latitude and longitude, time of arrival data, and menu data as shown in FIGS. 7A through 7D. The GPS display 410 is viewable by a user by pivoting the upper portion 120 to an open configuration as described above. Standard buttons 430, 440, 450, 460 for selecting desired GPS functions are provided along the left side of the lower portion 110 of the watch housing 100 (FIG. 1). Directional buttons 470*a* through 470*d* are provided along the right side of the watch housing 100 for setting desired GPS parameters (FIG. 3).

As best shown in FIGS. 5A through 6C, the lower portion 110 of the watch housing 100 includes a battery 420 for selectively supplying power to the global positioning system 400. The lower portion 110 further includes a compression spring 480 that is selectively compressible within a spring housing 482, the spring housing 482 being fixedly attached to an interior wall 484 of the lower portion 110 adjacent the hinge 130. The spring 480 is compressed according to lateral movement of a rod 486 within the spring housing 482. An upstanding flange 488 is normal to the rod 486. Another flange 134 is normal to the hinge 130 and rotates with the hinge 130 as the upper portion is opened or closed. Thus, the hinge flange 134 bears against the rod flange 488 to compress the spring 480 as the upper portion is moved to a closed configuration (FIG. 5A). Conversely, the hinge flange 134 releases the rod flange 488 as the upper portion 120 is rotated to an open configuration which allows the spring 480 to decompress so as to laterally extend the rod 486 to a FIG. 6 configuration. An arm 490 having a plate 492 fixedly attached thereto laterally extends from the global positioning system 400 to a position adjacent the spring housing 482 such that the free end of the rod 486 may selectively bear against the plate 492 upon decompression of the spring 480. The rod 486, flange 488, arm 490, and plate 492 are constructed of steel or other electrically conductive material. The battery 420 delivers power to the rod flange 488 through a wire 494 such that power is delivered to the global positioning system 400 upon contact between the rod 486 and plate 492.

In operation, the watch housing 100 may be strapped to the wrist of a user for providing easy access to the timepiece 200, pager 300, and global positioning system 400. With the watch housing 100 in a FIG. 1 configuration, a user may view the analog display 210 showing the relative time. In this closed configuration, the spring 480 is fully compressed such that battery power is not supplied to the global positioning system (FIG. 5A). When the message indicator display 320 indicates that a message has been received by the pager 300, the user can rotate the upper portion 120 to a FIG. 6 configuration for viewing or deleting pager messages. As the upper portion 120 is rotated upward, the spring 480 is released and allowed to decompress. As the spring 480 decompresses, the rod 486 is moved laterally to bear against the plate 492 of the arm 490 so as to deliver battery power to the global positioning system 400. Accordingly, the user may then view the digital display 410 of the global positioning system 400 and manipulate the functions thereof.

Accordingly, the present invention provides a timepiece with a pager 300 and global positioning system 400 in a single housing 100 that may be worn by a user. The timekeeping assembly 200, pager 300, and global positioning system 400 each include separate and distinct displays such that each display may be viewed without obstruction of another display. Further, battery power is conserved in that the global positioning system is only powered upon a user placing the watch housing 100 in an open configuration.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A combination timekeeping, paging, and positioning system, comprising:

a wristwatch housing having a lower portion and an upper portion attached to the lower portion with a single hinge for selective pivotable movement between open and closed configurations, the upper portion and lower portion each presenting an upper surface, said watch housing defining an interior space;

a timekeeping assembly mounted within the interior space of the upper portion of the wristwatch housing;

a display means positioned on the upper surface of the upper portion for indicating a relative time;

a pager mounted within the interior space of the upper portion of the wristwatch housing;

means on said display means for indicating that a message has been received by the pager;

a first digital display means positioned on the lower surface of the upper portion for displaying information indicative of the message received by the pager, whereby the first digital display means is viewable when the upper and lower portions are in an open configuration such that the display means does not obstruct the first digital display means;

is a global positioning system mounted within the interior space of the lower portion of the watch housing;

a second digital display means positioned on the upper surface of the lower portion of the watch housing for displaying information indicative of a user's geographic position and estimated time of arrival at a selected location, whereby the second digital display means is viewable when the upper and lower portions are in an open configuration such that the display means does not obstruct the second digital display means;

a battery power source mounted within the interior space of the watch housing; and means for selectively coupling the battery power source to the global positioning system, whereby the global positioning system is activated upon a rotation of the upper portion to an open configuration and deactivated upon a rotation of the upper portion to a closed configuration.

2. The timepiece as in claim 1 wherein the first display means is an analog display having at least two hands for indicating a relative time.

3. The timepiece as in claim 1 wherein the first display means is a digital display for indicating a relative time.

4. The timepiece as in claim 1 wherein the digital display means generally covers an entirety of the upper surface of the lower portion of the watch housing.

* * * * *